US005860187A

United States Patent [19]

Flaszynski et al.

[11] Patent Number: 5,860,187

[45] Date of Patent: Jan. 19, 1999

[54] CLEANING SYSTEM FOR REMOVING DUST DEPOSITS FROM DUCTWORK

[76] Inventors: Andrzej Flaszynski, Ramulta 33D/11, 81-241 Golynia, Poland; Wilhelm Lilliehook, 648 Coral Dr., Cape Coral, Fla. 33904

[21] Appl. No.: 814,807

[22] Filed: Mar. 10, 1997

Related U.S. Application Data

[60] Provisional application No. 60/013,252 Mar. 11, 1996.

[51] Int. Cl. [6] ..... B08B 5/02

[52] U.S. Cl. ..... 15/304; 15/316.1; 15/404

[58] Field of Search ..... 15/304, 316.1, 15/395, 404

[56] References Cited

U.S. PATENT DOCUMENTS

| | | | |
|---|---|---|---|
| 4,364,147 | 12/1982 | Biedermann et al. | 15/404 |
| 4,461,651 | 7/1984 | Hall | 15/404 X |
| 4,468,835 | 9/1984 | Rhodes | 15/404 X |
| 4,677,704 | 7/1987 | Huggins | 15/404 X |
| 5,400,466 | 3/1995 | Alderman et al. | 15/404 X |
| 5,572,766 | 11/1996 | Matsuura et al. | 15/304 |
| 5,724,701 | 3/1998 | Jones | 15/304 |

FOREIGN PATENT DOCUMENTS 2261080 11/1994 United Kingdom .

*Primary Examiner*—Chris K. Moore

*Attorney, Agent, or Firm*—J. M. (Mark) Gilbreth; Robert W. Strozier; Gilbreth & Strozier, P.C.

[57] ABSTRACT

The present invention discloses a portable cleaning system for ductwork and a method utilizing the cleaning system. The system includes a sound or air pulse generator for producing infrasound air pulses for short duration and introducing the air pulses into an air conduit which causes the air conduit to resonate or vibrate at a given infrasound frequency. The induced vibration causes contaminants in the ductwork to be entrained in the air pulses and carried with the air pulses to an exit of the air conduit where the air is filtered to remove the contaminants.

15 Claims, 2 Drawing Sheets

CLEANING SYSTEM FOR REMOVING DUST DEPOSITS FROM DUCTWORK

RELATED APPLICATION DATE

This application claims priority from U.S. Provisional application Ser. No. 60/013,252 filed Mar. 11, 1996.

BACKGROUND OF THE INVENTION

1. Field of the Invention

The present invention relates to systems for removing contaminants from ductwork and other air handling system components in which accumulated contaminants such as dust may occur.

2. Description of the Related Art

It is know that deposits formed by air borne contaminants on surfaces may be broken down and removed by applying impulses of low-frequency sound to a resonator in communication with the space containing the surfaces to be cleaned. The sound, for instance at frequencies of the order of 20 Hz or lower, is typically generated in a generator which interrupts a pressurized air flow at intervals corresponding to the desired frequency. The resulting pulses or impulses of sound are generally applied to the resonator for short periods, e.g., a few seconds.

Several examples of sound cleaning systems have been utilized for soot removal in fixed space stacks or furnaces. One such system is disclosed in British Patent No. 2,261,080B, where a sound generator produced air pulses that are communicated to a resonance tube which is then inserted into a furnace cavity to be cleaned. However, these fixed systems are not portable and requires resonance tubes for their effective operation and use.

Thus, there is a need for a system for cleaning ductwork associated with air handlers such as commercial and residential air conditioning and heating systems as well as other air handling systems that is portable and does not require the use of cumbersome resonators.

SUMMARY OF THE INVENTION

The present invention provides a portable, pulsed air cleaning system for cleaning ductwork including a compressor for supplying a source of pressurized air to a reservoir connected thereto where the reservoir is for receiving, storing and dispensing a supply of pressurized air produced by the compressor.

The system also includes a tunable sound generator connected to the reservoir where the generator produces air pulses (sound waves) of a given frequency from the supply of pressurized air dispensed from the reservoir. The air pulses or sound waves are then propagate through a flexible tubing connecting the generator with a first or proximal end of an air conduit to be cleaned where the conduit is capable of resonating at the given frequency. The system also includes a means for collecting the contaminants from a second or distal end of the air conduit where the air pulses exit the conduit with entrained contaminants for later disposal.

The system can further includes a valve disposed between and communicating with the reservoir and the sound generator. The system can also include a motor for driving the sound generator. The system also includes an electrical system having a control circuit in electrical communication with: (1) a pressure sensor attached to the reservoir that monitors changes in air pressure in the reservoir; (2) the sound generator motor; (3) the compressor; and optionally (4) with the valve. Additionally, the control circuit can be in electric communication with a contaminant monitoring sensor associated with the means for collecting the contaminants so that the system can be run for a sufficient time to achieve a desired level of cleaning (i.e., desired concentration of particulate matter in the exiting air pulses).

Upon detecting signals from the sensor corresponding to certain pressures in the reservoir, the control circuit stops or starts the generator motor and starts or stops the compressor and can optionally open or close the valve between the generator and reservoir, by sending out appropriated signals to the compressor, the generator motor and optionally the valve. Of course, an ordinary artisan would recognize that for the control circuit to accomplish these tasks the compressor, the generator motor and optionally the valve must have associated therewith control circuitry and logic capable of acting on the signals received from the control circuit as is well known in the art. Additionally, the valve would have to be an electrically activated valve with an appropriate power supply. Alternatively, the valve can be a manual valve that is opened and closed by an operator.

The present invention also provides a method for cleaning ductwork including the steps of providing a supply of pressurized air to a periodic air pulse or sound generator. The generator then generates periodic air pulses at a given frequency in the generator and the pulses are communicated to a first end of an air conduit, where the frequency causes the conduit to vibrate or resonate at the frequency in response to the air pulses propagating through the conduit. The air pulses or sound waves are then allowed to propagate down the conduit for a short time duration. As the pulses propagate down the conduit, contaminants are dislodged by and entrained in the pulses and carried to a second end of the conduit. The contaminants are then collected at the second end of the conduit for later disposal.

The method of the present invention may also include the step of applying an antifungal and/or an antibacterial agents to the conduit and any conduit termination plate associated with the conduit at its ends. The application step may be carried out in conjunction with the air pulses by injecting the agents into the supply of pressurized air prior to the air supply reaching the generator.

BRIEF SUMMARY OF THE DRAWINGS

For a more complete understanding of the present invention and the features and advantages thereof, reference is now made to the Detailed Description in conjunction with the attached Drawings, in which.

DETAILED DESCRIPTION OF THE INVENTION

Figure 1:
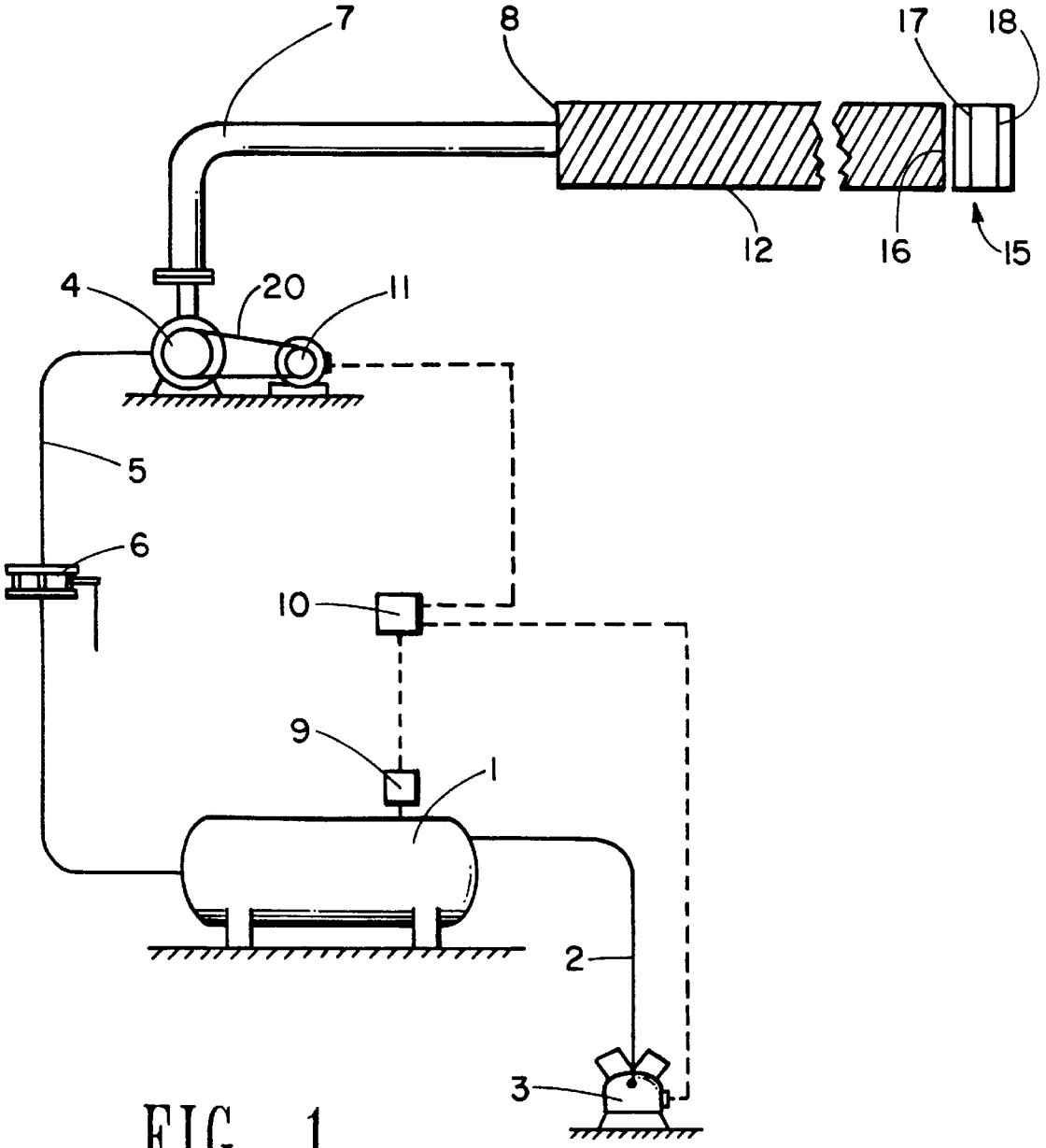
FIG. 1 is a schematic representation of one preferred embodiment of the present invention.

The inventors have found that an efficient ductwork cleaning system can be achieved by generating air pulses or sound waves in a supply of pressurized air at a given, tunable frequency and allowing the pulses or waves to be introduced directly into an air conduit at a first end, where the frequency is tuned so that the air conduit vibrates or resonates at the frequency in response to the introduction and propagation of the air pulses or sound waves down the conduit.

The sonic cleaning system for removing contaminants for ductwork includes the following: a compressor for supplying a source of compressed air; a reservoir for containing the compressed air supplied from the compressor; a sound generator which receives a continuous flow of compressed air from the reservoir and interrupts the air flow at a given frequency to produce a pulse sequence of air pulse of the frequency for a short duration; an optional valve disposed between and communicating with the reservoir and the sound generator; a pressure sensor for measuring the pressure of the compressed air contained in the reservoir; an electric system for supplying electricity to the compressor, the sound generator, and optionally the valve, for monitoring the pressure sensor and for starting and stopping the generator, the compressor and optionally the valve in response to changes in pressure in the reservoir; a flexible member connecting the generator to a first end of an air conduit to be cleaned where the member is capable of communicating the pulse sequence of compressed air into the conduit; and a contaminant collection system adapted to remove contaminants from a distal end of the conduct where the contaminants were dislodged from and entrained in the air pulses due to vibrations set up in the conduit by the pulse sequences propagating down the conduit.

The method for cleaning ductwork includes the following steps: providing a source of compressed air from means for supplying compressed air; storing the compressed air in a reservoir; supplying a continuous flow of the compressed from the reservoir to a sound generator when an optional valve between the reservoir and the generator is in an opened condition where the generator receives the continuous flow of compressed air from the reservoir and interrupts the air flow at a given frequency to produce a pulse sequence of air pulse of the frequency for a short duration; communicating with pulse sequence of compressed air from the generator to a first end of an air conduit to be cleaned from a flexible connection member; allowing the pulse sequence to enter and propagate down the conduit to a distal end; and collecting contaminants from a distal end of the conduct in a contaminant collection system adapted to remove the contaminants from the air pulses exiting the conduit where the contaminants were dislodged from and entrained in the air pulses due to vibrations set up in the conduit by the pulse sequences propagating down the conduit.

As the air pulses or waves enter and propagate down the conduit, the conduit vibrates at the frequency, which is thought to cause contaminants such as dust, pollen, lent, dirt or the like to be dislodged from the conduit and entrained in the air pulses. The entrained contaminants are then carried with the air pulses and exit with the air pulses at a distal or other end of the conduit. The contaminants are generally collected as they exit the conduit to preclude re-introduction of the contaminants back into the air handling system at some other entry point. Any means for collection or any particulate collection system can be used including filtration or vacuum systems connected to the distal end of the conduit. The collection system receives the exiting pulses with entrained contaminants and removes the contaminants from the pulses.

The basic apparatus for cleaning air ducts or ductwork associated with air handling systems includes a source of compressed air such as, and preferably, a compressor, but other compressed air sources can be used as well such as compressed air tanks or tank farms. The compressor supplies the compressed air to a reservoir which receives and stores the compressed air and dispenses a supply of compressed air to downstream components. The compressed air is supplied to an air pulse or sound generator through a control valve, where the generator converts the continuously supplied compressed air from the reservoir into air pulses or waves at a given frequency and where the valve has opened and closed conditions to start or to stop compressed air flowing to the generator, respectively.

The generator is in air communication with a first end of an air conduit by way of a flexible member which connects the generator to the first end of conduit. The air pulses are generated at the generator and propagate down the flexible member and enter the conduit. Once in the conduit, the air pulses cause the conduit to vibrate or resonate at the given frequency. Of course, the diameter of the air conduit will determine a usable frequency range for effective propagation of the air pulses down the conduit. Generally, the frequency will be in the so-call infrasound region of the sound spectrum. The infrasound region includes sound waves or air pulses having a frequency range between about 0 Hz and 20 Hz or wavelength between about infinity and 17 meters. The preferred frequency range is between about 2 Hz and 20 Hz. However, higher frequencies can be used if desired.

Additionally, the air pulses or sound waves should have a power value or dB level sufficiently high to effect efficient cleaning of the conduit. Generally, the pulses have a dB level between about 100 dB and about 160 dB with a level between about 120 dB and about 140 dB being preferred. When the frequency is properly tuned for a given conduit, the dB value of the air pulses should decay only about 10 dB to 15 dB after propagation approximately 10 meters into the conduit. The power level will, of course, continue to decay after that, but the rate of decay is significantly slower than the drop which occurs within the first several meters.

Of course, one of ordinary skill in the art would understand that not all air conduits are capable of vibrating or resonating with the air pulses being introduced therein. Thus, the present invention finds application only with ductwork that is capable of vibrating or resonating at the frequency of the air pulses. Suitable ductwork includes, without limitation, metal ductwork such as aluminum or steel air ducts, non-damping composite or plastic ductwork or the like. Ductwork which is currently difficult to clean by the present apparatus and method are ductwork that is internally insulated, i.e., the insulation was deposited on the interior of the air duct.

Additionally, certain types of plastics or rubber tubing are difficult to clean in accordance with the present invention, because many of these materials are highly damping and quickly dissipate the energy of the air pulses. However, many of these systems can be cleaned in accordance with the present invention by carefully controlling the frequency of the air pulses.

The air pulses are generated only for a short and finite duration. The duration is dependent on the reservoir size, the compressor size, and the generator size, but generally, the air pulse duration is from about 1 second to several tens of seconds with a duration of about 1 second to about 5 seconds being preferred. However, shorter or longer durations can be used if desired; provided however, that the reservoir can continue supplying compressed air above its lower pressure limit which is generally 4 bar. As the generator operates for this short and finite duration, a pulse sequence is generated. Each pulse sequence is separated by a time sufficient for the compressor to rebuild an operating pressure or to re-establish an upper pressure limit in the reservoir.

Surprisingly, most air conduits can be cleaned with only a limited number of pulse sequences. Generally, the present invention allows the conduits to be effectively cleaned of contaminants when exposed to between about 1 and about 20 pulse sequences with exposures of between about 1 and about 5 pulse sequences being preferred. Of course, the number of pulse sequences used will depend to some extent on the amount of contaminants in the conduit, the length of the conduit and the power level of the air pulses.

Although general and preferred sequence numbers are taught, the ordinary artisan should recognize that the cleaning operation can be continued until the amount of contaminants entrained in the exiting air pulses is below some set level. Thus, the present invention can also include a contaminant sensor associated with the collection system that is in electric communication with the control circuit. The sensor is designed to send a signal to the control circuit that the contaminant level in the exiting pulses is below some predetermined low valve. The control circuit would then, in response to such a signal, stop the compressor, stop the generator motor and close the valve allowing the flexible member or tubing to be disconnected from the cleaned conduit and connect to another air conduit to be cleaned.

Once the pulses are introduced into the conduit, they induce the conduit to vibrate or resonate at the given frequency. The vibrations in the conduit cause contaminants to be dislodged and entrained in the air pulses as they propagate through the conduit. The entrained contaminants are carried with the pulses and exit the conduit at an other end of the conduit entrained in the pulses. The other end of the conduit is generally and preferably equipped with a contaminant collection system for removing the entrained contaminants from the pulses. The collected contaminants can then be discarded without re-contamination of the air handling ductwork. Any collection system can be used including, without limitation, filtering systems, both single stage and multi-stage filtering systems, vacuum systems or the like. By multi-stage filtering systems, the inventors mean filtering systems that have more than one filter of differing particle size retention factors. Thus, the first stage would take out relative large particle sized contaminants, while each subsequent stage would take out smaller particle sized contaminants. The preferred multi-stage filtering systems for use with the present invention are so-called two stage filtering systems as are well known in the art.

Of course, it must be recognized that for complex air handling systems it is preferred that each conduit pathway be cleaned separately. This may require the cleaning crew to selectively isolate portions of the ductwork so that the conduit to be cleaned has only two openings; one to be used as the air pulse introduction end and the other end to be used as the air pulse discharge end and contaminant collection end. The present invention does not restrict use to isolated conduits, but as the number of exits in a pathway increases the cleaning efficiency per pathway decreases because the air pulses must be split between the various pathways.

In addition to the compressor, reservoir, generator, flexible attachment member and the collection system, the cleaning system of the present invention also includes an electric system for allowing the generator to operate only when a pressure in the reservoir is within some operating pressure range and to stop the generator when the pressure in the reservoir falls below some lower pressure limit. The electric system includes a power supply, a control circuit and a pressure sensor attached to the reservoir for measuring the pressure in the reservoir. The control circuit monitors the pressure sensor output and causes the generator and the compressor either to be started or stopped depending on the measured pressure in the reservoir. Optionally, the circuit can control the opening and closing of a valve between the reservoir and the generator. Thus, when a pressure in the reservoir reaches a lower pressure limit, the control circuit stops the generator by turning off an electric motor associated with the generator, starts the compressor supplying pressurized air to the reservoir to re-pressurize the reservoir and can close the valve between the reservoir and the generator. On the other hand, when the pressure in the reservoir reaches an upper limit, the control circuit stops the compressor, starts the generator, and optionally opens the valve.

Sound generators which function by interrupting a supply of air or gas are well known. The form of sound generator particularly preferred for use in the cleaning system according to the present invention is a rotary generator in which one or more apertures in a rotary member move into and out of register with one or more apertures in a fixed member as the rotary member rotates. The sound generator, which functions by interrupting at regular intervals, includes a supply of air under pressure, a reservoir for containing said air and supplying it to said sound generator, and a flexible tube adapted to receive sound pulses produced by said sound generator and to connect to an air conduit to be cleaned. Because air conduits differ in diameter and length, the generator is preferably tunable to frequencies of sound in the infrasound region of the sound spectra. Tunability can either be achieved by using a variable speed electric motor, where the motor speed can be set by an operator or controlled by the control circuit. Alternatively, the generator-motor assembly can have a belt drive system that allows for different generator speeds by changing the belt size and the relative separation between the motor and the generator or change the size of a belt drive sprocket on the motor.

The valve is preferably of the type having straight-through flow passage therein which can be closed by rotation of a rotary valve member. Suitable valves meeting these criteria are butterfly valves. Typically, the valve will be opened for only a small portion of the time. For example, the valve may be opened for, say 3 seconds.

The flexible member is any flexible tubing that will not unduly dampen or dissipate the air pulses and can be readily attached to the air conduit through either direct insertion into the conduit, a flange for accepting the introduction end of the conduit or an adaptor attached to the conduit coupling the end of the member.

The invention will now be further described with reference to FIG. 1, which illustrates schematically one preferred embodiment of the system according to the present invention.

The cleaning system, generally, includes an air reservoir 1, supplied with compressed air by a line 2 from an air compressor 3. Compressed air from the reservoir 1 is fed to a rotary sound generator 4 with its associated electric motor 11 via line 5 in which is disposed a valve 6. The electric motor 11 rotates the generator 4 by means of a drive belt 20. However, any other drive coupling assembly could be used as well including, without limitation, direct drive assemblies.

When the valve 6 is in an open condition and the sound generator 4 is rotating, the compressed air is converted from a continuous flow into a pulsed flow of a predetermined frequency, typically in the so-call infrasound region of the sound frequency spectra. The air pulses are then transmitted by a flexible line or tubing 7, to a proximal or first end 8 of an air conduit or duct 12.

A pressure sensor or switch 9, supplied with electrical power by a unit 10, is set to send an electrical signal to a control circuit associated with the unit 10 when the pressure in the air reservoir 1 rises above 8 bar or drops below 4 bar. The control circuit associated with the unit 10 in turn sends a signal to the air compressor 3 and the electric motor 11 causing the compressor 3 and/or the electric motor 11 to turn off or on. The unit 10 also supplies electrical power to the electric motor 11 by means of which the sound generator 4 is driven. Thus, as the reservoir pressure rises above 8 bar, the valve 6 can be opened by an operator, the sound generator is switched on in response to a signal from the unit 10, and the compressor 3 is turned off in response to a signal from the unit 10.

As air flows through the valve 6 to the sound generator 4 and ultimately to the conduit 12, the pressure in the air reservoir 1 falls. When the pressure drops below 4 bar, the pressure sensor 9 send a signal to the control circuit associated with the unit 10 which causes signals to be sent to the motor 11 to stop rotating the sound generator 4 and the valve 6 is manually closed. With the valve 6 closed, the reservoir 1 is re-pressurized until the pressure in the reservoir 1 reaches 8 bar at which time the sensor 9 sends an appropriate signal to the unit 10 which in turn starts the electric motor 11 associated with the generator 4 and stops the compressor 3.

This cycle can be repeated as many times as is necessary to clean a given air conduit. Because the rate of flow of air out via the sound generator 4 greatly exceeds the inward flow from the compressor, the pressure falls much more quickly than it rises, with the result that the period for which the sound generator operates is much less than the re-pressurization time interval. Generally, the sound generator operates for about 1 to about several ten of seconds, while the re-pressurization can require several minutes, typically about of 5 minutes. However, multiple compressors can be used to shorten the re-pressurization rate and allow more pulse sequences to be generated in a given period of time. The need for additional compressors is not great because, surprisingly, only a relatively small number of pulse sequences is required to clean an air duct.

Finally, the system also includes a contaminant collection system 15 associated with a second end 16 of conduit 12. In FIG. 1, the collection system 15 is shown as a two-stage filter having a course filter stage 17 in front of a fine filter stage 18.

Figure 2:
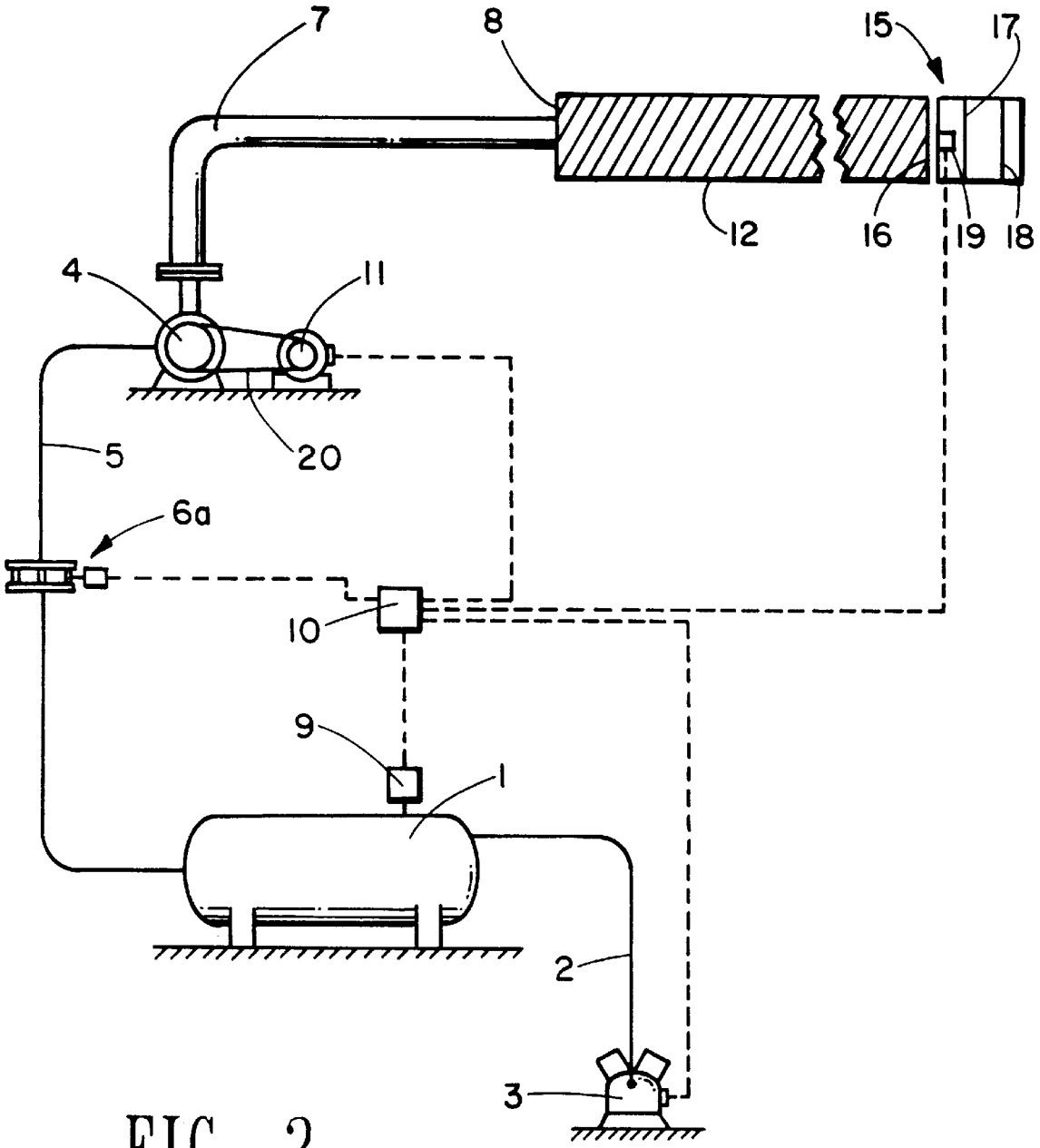
FIG. 2 is a schematic representation of another preferred embodiment of the present invention.

Referring now to FIG. 2, an alternate embodiment of the cleaning system of the present invention is shown. In this embodiment all major parts as described in FIG. 1 are repeated with the inclusion of a electrical communication means from the unit 10 to an electrically operated valve 6*a* where the valve 6*a* can open or close in response to an appropriate signal from the control circuit associated with the unit 10. Additionally, this embodiment includes a contaminant sensor 19 associated with the collection system 15 which monitors the level of contaminant in the air pulses either before or after the coarse filter 17 (shown before the filter 17 in FIG. 2). The contaminant sensor can be an electric conductivity detector, a light transmission detector, or any other type of detector capable of monitoring solid contaminants in air.

The pressure sensor 9 associated with the reservoir 1 in cooperation with the control circuit causes the electrically operated master valve 6*a* to either open or close in response to changes in pressure in the reservoir 1. Thus the sensor 9 may produce a first signal when pressure in the reservoir reaches a predetermined upper value, which signal causes the control circuit to signal the valve 6*a* to open, and produce a second signal when the reservoir pressure falls to a predetermined lower value, which second signal causes the control circuit to signal the valve 6*a* to close. Since opening of the valve 6*a* causes the reservoir pressure to fall and closing of the valve 6*a* allows the pressure to rise, the valve 6*a* will open and close at regular intervals. The length of those intervals may be varied by modifying the rate at which air or gas is supplied to the reservoir 1; good control of that interval length may be achieved by installing a suitable valve, for example a needle valve, in the line supplying the reservoir 1. Typically, the master valve 6*a* will be opened for only a small proportion of the time, compared with the interval between openings. For example, the valve may open for, say, 4 seconds every 4 minutes.

Preferably, the control circuit simultaneously controls the state of the compressor 3, the generator motor 4, and the valve 6*a* in response to signal form the pressure sensor 9. Additionally, the control circuit continues to open and close the valve 6*a* until the contaminant sensor 19 sends the control circuit an appropriate signal indicating that the air pulses satisfy some predetermined low value of contaminants in the air pulses.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. A sonic cleaning system for removing contaminants for ductwork comprising:

a. a compressor for supplying a source of compressed air;

b. a reservoir for containing the compressed air supplied from the compressor;

c. a tunable sound generator which receives a continuous flow of compressed air from the reservoir and interrupts the air flow at a given frequency to produce a pulse sequence of air pulses of the frequency for a short duration;

d. a pressure sensor for measuring the pressure of the compressed air in the reservoir;

e. an electrical control system for supplying electricity to the compressor, the sound generator, for monitoring the pressure sensor and for starting and stopping the generator and the compressor in response to changes in pressure in the reservoir;

f. a flexible tubular member for transmitting pressure waves connecting the generator to a proximal end of an air conduit to be cleaned where the member is capable of communicating the pulse sequence of compressed air into the conduit; and g. a contaminant collection system adapted to remove contaminants from a distal end of the conduit where the contaminants were dislodged from and entrained in the air pulses due to vibrations set up in the conduit by the pulse sequence propagating down the conduit.

2. The system of claim 1, wherein the sound generator is a rotary generator in which one or more apertures in a rotary member move into and out of register with one or more apertures in a fixed member as the rotary member rotates.

3. The system of claim 1 further comprising:

(h) a valve disposed between and communicating with the reservoir and the sound generator.

4. The system of claim 1 further comprising:

(i) a contaminant monitoring sensor associated with the containment collection system.

5. The system of claim 1, wherein the containment collection system is a multi-stage filtering system.

6. The system of claim 1, wherein the frequency of the air pulses are in the ultrasound region of the sound spectrum.

7. The system of claim 6, wherein the frequency of the air pulses are between about 0 to about 20 Hz.

8. The system of claim 7, wherein the frequency of the air pulses are between about 2 Hz to about 20 Hz.

9. The system of claim 1, wherein the air pulses have a power value that decays only about 10 dB to 15 dB after propagating about 10 meters into the conduit.

10. The system of claim 9, wherein the air pulses have a power value of between about 100 dB to about 160 dB.

11. The system of claim 10, wherein the air pulses have a power value of between about 120 dB to about 140 dB.

12. The system of claim 1, wherein the duration of the air pulses is between about 1 second to about 100 seconds.

13. The system of claim 12, wherein the duration of the air pulses is between about 1 second to about 5 seconds.

14. The system of claim 1, wherein the pulse sequence is between about 1 pulse per second to about 20 pulses per seconds.

15. The system of claim 14, wherein the pulse sequence is between about 1 pulse per second to about 5 pulses per seconds.

* * * * *